US005405037A

United States Patent [19]

Piron

[11] Patent Number: 5,405,037

[45] Date of Patent: Apr. 11, 1995

[54] CONTAINER CLOSURE AND LOCKING SYSTEM

[76] Inventor: Ludwig A. Piron, 339 Glenridge Drive, Waterloo, Ontario, Canada, N2J-3W7

[21] Appl. No.: 209,467

[22] Filed: Mar. 14, 1994

[51] Int. Cl.[6] ..... B65D 43/26; B65D 55/14

[52] U.S. Cl. ..... 220/230; 292/251.5; 220/284

[58] Field of Search ..... 220/230, 284, 308; 215/302, 303, 317, 301, 226, 215, 225; 292/251.5, DIG. 61, DIG. 63, DIG. 65

[56] References Cited

U.S. PATENT DOCUMENTS

| | | | |
|---|---|---|---|
| 3,638,285 | 2/1972 | Giraldez | 24/108 |
| 3,782,147 | 1/1974 | Hallmann | 70/276 |
| 3,961,721 | 6/1976 | Gordon et al. | 220/230 |
| 4,223,799 | 7/1980 | Eyster et al. | 220/230 |
| 4,310,188 | 1/1982 | Aoki | 292/251.5 |
| 5,188,405 | 2/1993 | Maccaferri | 292/251.5 X |

FOREIGN PATENT DOCUMENTS

| | | | |
|---|---|---|---|
| 2233247 | 1/1975 | France | 215/317 |
| 67616 | 7/1892 | Germany . | |

*Primary Examiner*—Allan N. Shoap
*Assistant Examiner*—Nathan J. Newhouse
*Attorney, Agent, or Firm*—Richard L. Miller

[57] ABSTRACT

A container closure and locking system, for selectively allowing access to a container having a lip, comprising a container cap, and a key. The key further comprises a magnet. The container cap further comprises an upper cap, a lower cap, a latch mounted between the upper cap and lower cap, and a center spring. The upper cap and lower cap are rigidly attached to one another. The latch has a lower latch, which grasps the lower cap and the lip. The latch has an upper latch and a fulcrum. The fulcrum attaches to a pivot point on the upper cap. The center spring is mounted between the upper cap and lower cap. The center spring presses against the upper latch, to bias the fulcrum against the pivot point, to maintain the lower latch in position grasping the lip. The magnet acts upon the latch, pulling the lower latch away from the lip to release the container cap from the container.

13 Claims, 2 Drawing Sheets

FIG. 2
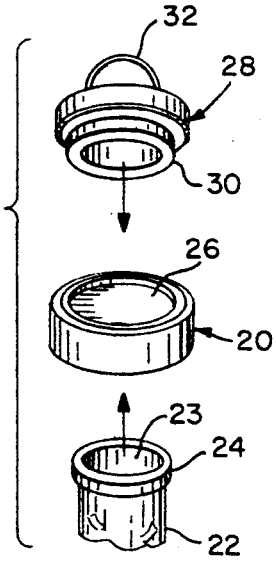
FIG. 1
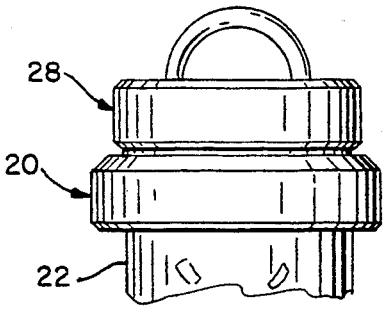
FIG. 4
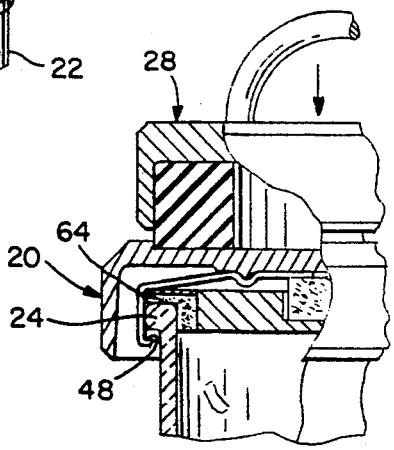
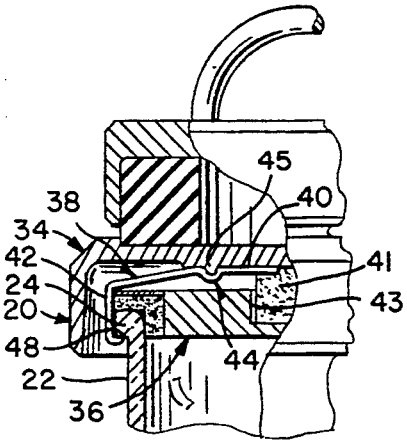
FIG. 3
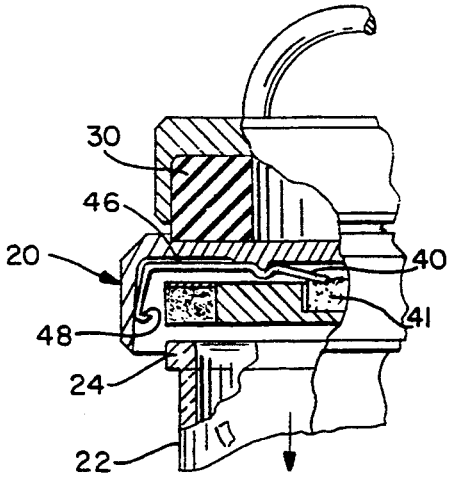
FIG. 5

FIG. 6
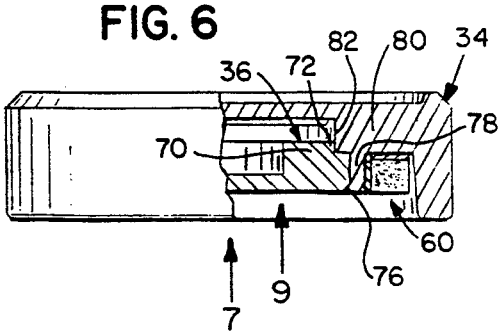
FIG. 8
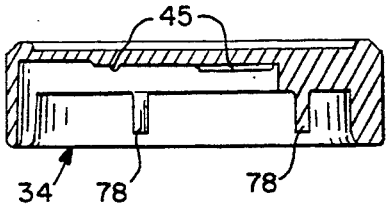
FIG. 7
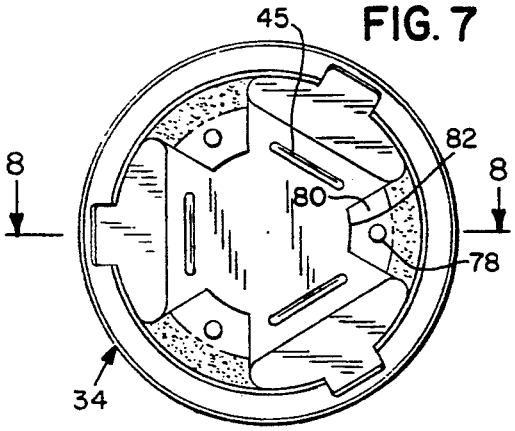
FIG. 10
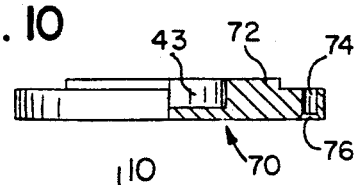
FIG. 9
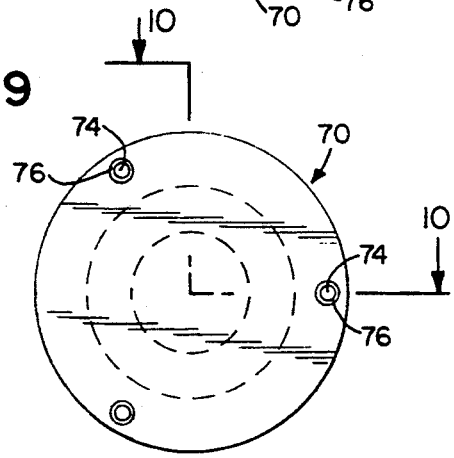
FIG. 12
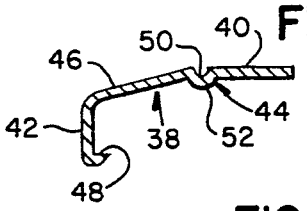
FIG. 11
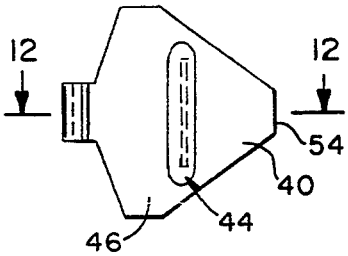
FIG. 13
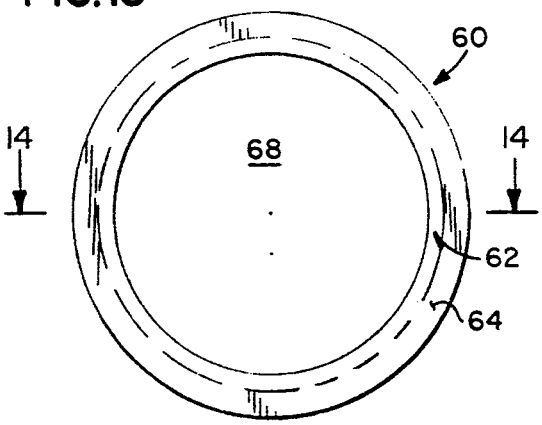
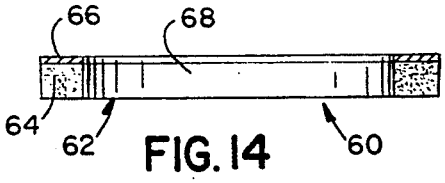
FIG. 14

CONTAINER CLOSURE AND LOCKING SYSTEM

BACKGROUND OF THE INVENTION

The instant invention is the subject matter of Disclosure Document No.: 330280, filed in the PTO on May 6, 1993, and it is respectfully requested that this document be retained beyond the two-year period so that it may be relied upon as evidence of conception of the invention during the prosecution phase of this application, should the need arise.

The invention relates to a container closure and locking system. More particularly, the invention relates to a closure and locking system mounted on the top of a container, for selectively allowing or preventing access to the contents of the container.

Conventional container closure systems vary in complexity, ease of use, and protection against unauthorized access to the container contents.

Balancing the conflicting goals of container security and ease of use is always problematic. For example, conventional child-proof caps might provide marginal security to prevent a small child from accessing potentially harmful chemicals and medications. However these child-proof caps can be difficult to operate, especially for someone who has limited dexterity from arthritis or other illness.

Other systems have been devised in an attempt to provide adequate security, but maintain ease of use to authorized persons. These systems are generally too complicated to be economical.

U.S. Pat. No. 3,638,285 to Sanchez Giraldez, discloses a two-part lock button that is actuated by a magnetic key.

U.S. Pat. No. 3,782,147 to Hallmann, discloses a security lock employing a bolting unit that is movable by the proper orientation of magnets in a key.

U.S. Pat. No. 3,961,721 to Gordon et al., discloses a magnetic container cover, in which the cover is held in position by magnetic force.

U.S. Pat. No. 4,223,799 to Eyster et al., discloses a releasable locking means for closure caps.

German Patent No. 67616 to Abramowsky, discloses a locking mechanism.

While these units may be suitable for the particular purpose for which they are employed, or to general use, they would not be as suitable for the purposes of the present invention as hereafter described.

SUMMARY OF THE INVENTION

It is an object of the invention to produce a container closure and locking system that prevents unauthorized access to the contents of a container.

It is another object of the invention to produce a container closure system that requires little effort to open.

It is a further object of the invention to produce a container closure system that has a minimal number of parts, and can be economically manufactured.

It is a still further object of the invention to produce a container closure system that can be used on a variety of containers.

The invention is a container closure and locking system, for selectively allowing access to a container having a lip, comprising a container cap, and a key. The key further comprises a magnet. The container cap further comprises an upper cap, a lower cap, a latch mounted between the upper cap and lower cap, and a center spring. The upper cap and lower cap are rigidly attached to one another. The latch has a lower latch, which grasps the lower cap and the lip. The latch has an upper latch and a fulcrum. The fulcrum attaches to a pivot point on the upper cap. The center spring is mounted between the upper cap and lower cap. The center spring presses against the upper latch, to bias the fulcrum against the pivot point, to maintain the lower latch in position grasping the lip. The magnet acts upon the latch, pulling the lower latch away from the lip to release the container cap from the container.

To the accomplishment of the above and other related objects, the invention may be embodied in the form illustrated in the accompanying drawings. Attention is called to the fact that the drawings are illustrative only. Variations are contemplated as being part of the present invention, limited only by the scope of the claims.

BRIEF DESCRIPTION OF THE DRAWINGS

In the drawings, like elements are indicated by like reference numerals throughout the several views. The drawings are briefly described below.

FIG. 1 is a side elevational view of the instant invention.

FIG. 2 is a diagrammatic exploded perspective view, illustrating the magnetic key component, the container cap, and the container separated from each other.

FIG. 3 is an enlarged partially in section diagrammatic view with parts broken away, illustrating the cap latched on the container, with the magnetic key component resting thereon.

FIG. 4 is a view similar to FIG. 3, with the cap depressed on the container, showing the moment just before the latches release the container.

FIG. 5 is a view similar to FIG. 4, but showing the container released by the latches and the container cap partially removed therefrom.

FIG. 6 is an enlarged partially sectioned view, cut away, illustrating the securing of the lower cap to the upper cap.

FIG. 7 is a bottom plan view taken in the direction of arrow 7 in FIG. 6, of just the upper cap per se, with all other components removed.

FIG. 8 is a cross sectional view taken on line 8—8 of FIG. 7.

FIG. 9 is an elevational view taken in the direction of arrow 9 in FIG. 6 of just the a portion of the lower cap per se with all other components removed.

FIG. 10 is a partial cross sectional view taken on line 10—10 of FIG. 9.

FIG. 11 is a bottom plan view of a single latch element per se.

FIG. 12 is a cross sectional view, taken on line 12—12 of FIG. 11.

FIG. 13 is a bottom plan view of just the lower cap outer portion.

FIG. 14 is a cross sectional view, taken on line 14—14 of FIG. 13.

DETAILED DESCRIPTION OF THE PREFERRED EMBODIMENTS

FIG. 2 shows a container cap 20, which attaches on top of a container 22, having an open end 23, and having a lip 24 near the open end 23. The container cap 20 has an upper recess 26. A key 28, has a magnet 30, the magnet 30 being ring shaped. The magnet 30 is sized to fit within the upper recess 26 in the container cap 20. The key 28 has a handle 32 to ease the handling thereof.

Referring to FIG. 1, the container cap 20 is shown seated on top of the container 22. The key 28 is mated with the container cap. The container cap 20, the key 28, and the container 22 are the major components of the system of the present invention.

FIG. 3 illustrates the major components of the present invention, with parts broken away. The container cap 20 has an upper cap 34 and a lower cap 36. The upper cap 34 and lower cap 36 are rigidly attached to each other. The lower cap 36 rests on the lip 24 of the container 22.

A latch 38 is mounted between the upper cap 34 and lower cap 36. The latch 38 is made of a magnetically attractive material.

Referring to FIG. 12, the latch 38 has an upper latch 40, a lower latch 42, and a fulcrum 44. The latch also has a middle latch 46, between the lower latch 42 and fulcrum 44. The lower latch 42 has a latch hook 48. The fulcrum 44 has a concave notch 50, and a fulcrum support 52, the fulcrum support 52 is for preventing the latch from bending at the fulcrum 44 from internal stresses.

Referring to FIG. 3, a central spring 41, shown herein made of foam, rests in a central spring recess 43 in the lower cap 36. The central spring 41 exerts pressure against the upper latch 40, biasing the fulcrum 44 against a pivot point 45 in the upper cap 34, so that the lower latch 42 is held in position, grasping the lip 24 of the container 22 and the lower cap 36.

FIG. 11 further illustrates the latch 38 in a bottom plan view. When viewed from the bottom, the upper portion flares outward from an upper latch end 54 through the fulcrum 44, making the middle latch 46 substantially wider than the upper latch end 54. The middle latch 46 is made wider than other portions of the latch 38 to increase the surface area that the magnet 30 can act upon.

FIG. 13 and FIG. 14 illustrate a lower cap outer portion 60. The lower cap outer portion 60 is ring-like in shape. The lower cap outer portion 60 has a foam ring which when depressed against the lip 24 forms a foam shoulder 62, that has a foam step 64 that rests on top of and against the lip 24, as shown in FIG 3. The lower cap outer portion 60 also has a rigid ring 66, to give strength to the lower cap outer portion 60. The lower cap outer portion 60 also has a lower cap outer portion hole 68.

FIG. 9 and FIG. 10 illustrate a lower cap inner portion 70. The lower cap inner portion is ring-like in shape, and is sized to fit within the lower cap outer portion 60 in the lower cap outer portion hole 68. Illustrated is the central spring recess 43, present in the center of the lower cap inner portion 70. The lower cap inner portion 70 also has a lower cap inner portion step 72, and at least two attaching pin holes 74. The embodiment illustrated has three attaching pin holes 74. Each attaching pin hole 74 has a peen recess 76.

FIG. 7 and FIG. 8 illustrate the upper cap 34. The upper cap 34 is preferably formed from a single piece of material, such as a hard plastic. The upper cap 34 has plurality of attaching pins 78, matching the attaching pin holes 74 in the lower cap inner portion 70 in position and in number. The upper cap 34 has upper cap steps 80, upon which each attaching pin 78 is mounted. The upper cap steps 80 each have a concave inner edge 82 that matches the curvature of the lower cap inner portion step 72. Also illustrated are the pivot points 45 in the upper cap 34.

FIG. 6 illustrates the lower cap 36 rigidly connected to the upper cap 34 by the attaching pins 78. The lower cap inner portion 70 is fit within the lower cap outer portion 60. The lower cap 36 is mated with the upper cap 34, with the lower cap inner portion step 72 in contact with the concave inner edges 82 of the upper cap steps 80. The attaching pins 78 of the upper cap 34 are inserted through the attaching pin holes 74. The attaching pins 78 are then peened, and each fits snugly in the peen recess 76 of its associated attaching pin hole 74.

FIG. 3 illustrates the inner structure of the container cap 20, prior to the exertion of downward pressure on the container cap 20. The lower latch 42 is grasping the lip 24 and lower cap 36, the latch hook 48 preventing upward movement of the container cap 20.

In FIG. 4, downward pressure is exerted by the key 28, upon the container cap 20. The foam step 64 has been compressed, freeing the latch hook 48 from the lip 24.

In FIG. 5, the magnet 30, acting upon the middle latch 46, has pivoted the latch 38 about its fulcrum 44, pulling the latch hook 48 and the rest of the lower latch 42 away from the lip 24, effectively releasing the container cap 20 from the container 22. As the latch 38 is pivoted about the fulcrum 44, the upper latch 40 compresses the central spring 41. With the latch hook 48 clearing the lip 24, the container cap 20 can be pulled up and away from the container 22.

When the container cap 20 is replaced on the container 22 it is not necessary for the magnet 30 in the key 28 to be utilized to release the latch 38, because in response to the inserting of the lip 24 into the container cap 20 against the latch hooks 48 the central spring 41 compresses and decompresses, allowing the latches 38 to grasp the lip 24.

It is to be noted that although the instant invention is illustrated with three latches any plurality of latches, could be utilized as a matter of design choice and three is only typical of one such choice.

It is to be noted that although not specifically illustrated just one latch could be utilized in which case a fixed inoperative latch must be locate in the cap at a radial position 180 degrees from the operative latch. Naturally in this case the cover must be tilted slight when being removed or installed on the container.

What is claimed is:

1. A container closure and locking system, for closing and selectively allowing access to a container, the container having an open end and a lip near the open end, comprising:

a ) a container cap, having:

i) an upper cap, having an upper recess, and having a pivot point;

ii) a lower cap, rigidly attached to the upper cap, the lower cap covering the open end of the container resting on the lip;

iii) a latch, made from a magnetically attractive metal, mounted between the upper cap and lower cap, the latch having a lower latch, which grasps the lip and lower cap, the latch also having an upper latch, the latch further having a fulcrum attached to the upper cap at the pivot point; and iv) a central spring, the central spring pressing against the upper latch to keep the fulcrum biased against the pivot point, to maintain the lower latch in position grasping the lip and lower cap; and b) a key, having a magnet, sized to fit in the upper recess, whereby when the key is fitted in the upper recess the magnet acts upon the latch to move the lower latch away from the lip and lower cap the container cap is released from the container.

2. The container closure and locking system as recited in claim 1, wherein the central spring is made of foam, and is mounted between the upper cap and lower cap.

3. The container closure and locking system as recited in claim 2, where the lower cap further comprises:

a) an inner portion, having a spring recess where the central spring is mounted; and b) an outer portion, having a foam step which rests against the lip of the container, and having an outer portion hole within which the inner portion is snugly fit.

4. The container closure and locking system as recited in claim 3, where the upper cap further comprises at least two attaching pins, and the lower cap has matching attaching pin holes for rigidly attaching the upper cap to the lower cap.

5. The container closure and locking system as recited in claim 4, further having three latches, the upper cap having three pivot points.

6. The container closure and locking system as recited in claim 1, having one latch, and one pivot point in the upper cap.

7. The container closure and locking system as recited in claim 1, having at least two latches, and at least two pivot points in the upper cap.

8. The container closure and locking system as recited in claim 1, having three latches, and having three pivot points in the upper cap.

9. The container closure and locking system as recited in claim 8, where each latch further comprises an upper latch end and a middle latch, the upper latch flaring outward from the upper latch end through the fulcrum, making the middle latch substantially wider than the upper latch end.

10. The container closure and locking system container closure and locking system as recited in claim 1, where the lower cap further comprises a foam shoulder that rest on the lip.

11. A method for closing, locking, and selectively opening a container having a lip, with a container cover having an upper cap and lower cap having a foam shoulder, and a latch between the upper cover and lower cover, the latch having a lower latch and a middle latch, said latch being made of a magnetically attractive material, comprising the steps of:

a) griping the lip and lower cap with the lower latch, to hold the container cover to the container;

b) applying a magnet to the upper cap, attracting the middle latch, to pull the lower latch away from the lip; and c) pressing down upon the container cover to compress the foam shoulder to allow the lower latch to swing free of the lip and lower cover, to release the container cap from the container.

12. The method as recited in claim 11, where the steps of applying a magnet to the middle latch and of pressing down upon the container cover are performed at the same time with a magnetic key.

13. The method as recited in claim 11, further comprising the step of:

d) lifting the container cover up and away from the container.

* * * * *